US005485732A

United States Patent [19]

Locatelli

[11] Patent Number: 5,485,732

[45] Date of Patent: Jan. 23, 1996

[54] HEAT EXCHANGER, PARTICULARLY FOR USE AS A RACK EVAPORATOR IN REFRIGERATORS OR FREEZERS, AND PROCESS FOR MANUFACTURING IT

[75] Inventor: Vincenzo Locatelli, Lecco, Italy

[73] Assignee: Condenser Italiana S.R.L., Italy

[21] Appl. No.: 181,489

[22] Filed: Jan. 14, 1994

[30] Foreign Application Priority Data

Jan. 25, 1993 [IT] Italy ..... MI93A0111

[51] Int. Cl.[6] ..... F25B 39/00

[52] U.S. Cl. ..... 62/520; 165/47

[58] Field of Search ..... 62/520; 165/47

[56] References Cited

U.S. PATENT DOCUMENTS 2,334,284 11/1943 Philip ..... 62/520 X
2,473,508 6/1949 Collins .
3,144,079 8/1964 Mach ..... 62/520 X

FOREIGN PATENT DOCUMENTS 2008733 6/1979 United Kingdom .
2145806 4/1985 United Kingdom .

*Primary Examiner*—John C. Fox

[57] ABSTRACT

Heat exchanger, particularly for use as a rack evaporator in refrigerators or freezers, and process for manufacturing it. The heat exchanger is composed of a plurality of stacked shelves and comprises, for each shelf, at least one coil constituted by a tubular body extending along a path in which bends alternate with straight and substantially mutually co-planar portions, and a supporting and/or heat-exchange enhancing structure. In the heat exchanger according to the invention, the coils of two contiguous shelves are mutually connected by a tubular portion arranged transversely with respect to the direction along which the various shelves are stacked, starting from one corner of the overlying shelf down to one of the corners contiguous to the corresponding corner of the underlying shelf. The supporting and/or heat-exchange enhancing structure is disconnected from the branches of the coils joined to the tubular portion that mutually connects two coils in two different shelves.

8 Claims, 3 Drawing Sheets

HEAT EXCHANGER, PARTICULARLY FOR USE AS A RACK EVAPORATOR IN REFRIGERATORS OR FREEZERS, AND PROCESS FOR MANUFACTURING IT

BACKGROUND OF THE INVENTION

The present invention relates to a heat exchanger, particularly for use as a rack evaporator in refrigerators or freezers, and to a process for manufacturing it.

As is known, refrigerators are generally constituted by a box-like structure having an internal chamber which is kept at a controlled temperature by means of a refrigeration circuit. In order to achieve higher efficiency of the refrigeration circuit and keep the temperature inside refrigerators as uniform as possible, rack evaporators are generally used, arranging an evaporator coil in each shelf of the refrigerator and mutually connecting the evaporator coils of the various shelves that form, as a whole, the evaporator of the circuit.

More particularly, each shelf comprises a coil constituted by a tubular body extending along a path in which bends alternate with straight and substantially mutually co-planar portions, and by a supporting structure, which can be constituted by a plurality of parallel rods welded on at least one of the two faces of the coil or by a plate-like element which is seamed, welded or glued or otherwise rigidly connected to one side of the coil, has the purpose of forming a supporting surface suitable to support the products to be arranged on the shelves, and at the same time increases the heat-exchange surface of the coil.

Usually, the evaporator constituted by the coils forming the various shelves of the refrigerator, as well as the portions of the evaporator that mutually connect the various coils, are formed by shaping a plurality of separate tubular bodies (coils), subsequently assembled together with the rods or with the plate, thus forming the shelf which is in turn assembled together with other shelves by welding, forming the evaporator as a whole. The evaporator, in its final configuration, is thus constituted by a plurality of coils extending along mutually parallel and superimposed planes and mutually connected by tubular portions extending vertically between the various planes. Since each shelf has a substantially rectangular shape, the evaporator substantially has, as a whole, the shape of a parallelepiped in which the tubular portions connecting the various shelves are located generally at one or more of the edges of such a parallelepiped.

These known rack evaporators have some drawbacks, particularly as regards the bulk, due to the stacked arrangement of the various shelves and to the presence of the tubular portions connecting the various shelves.

A rack evaporator of the type described above in fact requires very large spaces which can entail problems during packaging, shipping and possible treatments to which the evaporator must be subjected. Furthermore, in the case of evaporators constituted by a plurality of separate shelves subsequently joined in the circuit by welding, a certain defectiveness can be noted due to leakage of the refrigerating gas from defective braze welds. Alternatively, the evaporator, with its shelves and various tube portions mutually connecting them, can be formed by means of the shaping of a single tubular body, followed by the welding of rods or by the seaming of the plate for each shelf and by the final shaping of the evaporator with parallel shelves.

In order to solve the drawback of bulk during packaging, shipping or treatment, in some rack evaporators the tubular portions that mutually connect the coils of the various shelves are arranged along a single edge of the parallelepipedal space occupied by the evaporator, and during packaging and shipping the shelves of other similar rack evaporators are inserted between two superimposed contiguous shelves of a same evaporator. This solution only partially solves the drawbacks linked to the packaging and shipping of rack evaporators, since the coupling of a plurality of rack evaporators significantly complicates packaging operations and makes it difficult to disengage the evaporators when they are used.

Furthermore, this contrivance to reduce the overall space required by rack evaporators cannot be adopted to reduce the individual bulk of each rack evaporator during possible treatments.

Furthermore, in known rack evaporators difficulties arise when bending the tubular body that constitutes the evaporator, particularly as regards the bending to which the portion connecting the coils between the various shelves must be subjected in order to always arrange this connecting portion at a single edge of the parallelepipedal space occupied by the evaporator.

SUMMARY OF THE INVENTION

The aim of the present invention is to eliminate the above described drawbacks by providing a heat exchanger, particularly for use as a rack evaporator in refrigerators or freezers, which can have, during its possible surface treatment, its packaging and shipping, a considerably limited bulk with respect to known rack evaporators.

Another object of the invention is to provide a heat exchanger which despite having a limited bulk, such as to facilitate its treatment, packaging and/or shipping, keeps unchanged the space available to support products inside a refrigerator.

Another object of the invention is to provide a heat exchanger highly reliable in use.

Another object of the invention is to provide a process for manufacturing heat exchangers, particularly rack evaporators, which is particularly simple and economical to perform.

Another object of the invention is to provide a heat exchanger, particularly suitable to be used as a rack evaporator, which can be manufactured with a distinctly lower cost, time and defectiveness than those arising from the manufacture of known rack evaporators.

With these and other objects in view, there is provided, according to the present invention, a rack heat exchanger, particularly for use as a rack evaporator in refrigerators or freezers, composed of a plurality of stacked shelves and comprising, for each shelf, a coil constituted by at least one tubular body extending along a path in which bends alternate with straight and substantially mutually co-planar portions, and a supporting and/or heat-exchange enhancing structure connected to each one of said coils; characterized in that the coils of two contiguous shelves are mutually connected by a tubular portion extending transversely with respect to the direction along which the various shelves are stacked, starting from one corner of the overlying shelf down to one of the corners contiguous to the corresponding corner of the underlying shelf, the branches of the coils connected to the tubular portion that mutually connects the coils of two shelves being disconnected from said supporting structure.

BRIEF DESCRIPTION OF THE DRAWINGS

Further characteristics and advantages of the present invention will become apparent from the following detailed description of some preferred but not exclusive embodiments thereof, illustrated only by way of non-limitative example in the accompanying drawings, wherein.

DESCRIPTION OF THE PREFERRED EMBODIMENTS

Figure 1:
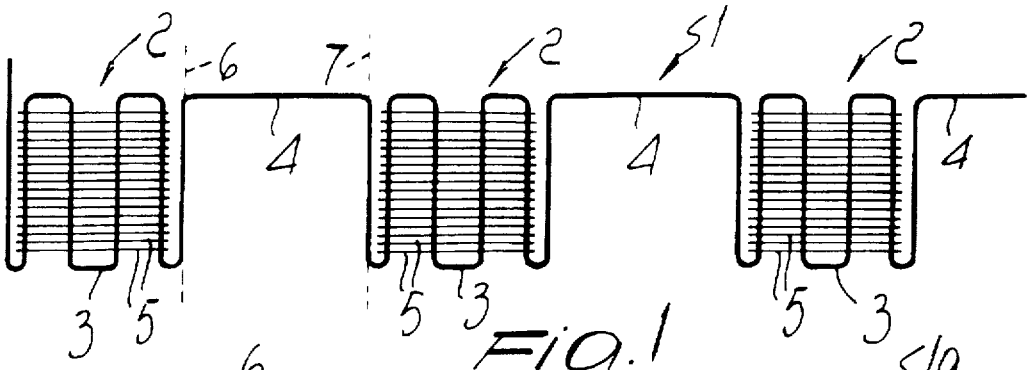
FIG. 1 is a view of the heat exchanger according to the invention, laid out on a plane.

With reference to the above figures, the heat exchanger according to the invention, generally designated by the reference numerals 1, 1*a*, 1*b*, 1*c* in its various embodiments, is composed of a plurality of stacked shelves 2, 2*a*, 2*b*, 2*c*, in which each shelf comprises a coil 3, 3*a*, 3*b*, 3*c* constituted by a tubular body that traces a path along which bends alternate with substantially mutually coplanar straight portions.

According to the invention, the coils 3, 3*a*, 3*b*, 3*c* of two contiguous shelves 2, 2*a*, 2*b*, 2*c* are mutually connected by a tubular portion 4, 4*a*, 4*b*, 4*c* extending transversely to the direction along which the various shelves 2, 2*a*, 2*b*, 2*c* are stacked, starting from one corner of the overlying shelf down to one of the corners contiguous to the corresponding corner of the underlying shelf.

More particularly, in each shelf, the coil 3, 3*a*, 3*b*, 3*c* lies within an ideal rectangle and the longer straight portions of the coils are arranged substantially parallel to two opposite sides of this ideal rectangle.

The tubular portion 4, 4*a*, 4*b*, 4*c* that mutually connects two contiguous stacked coils is straight and extends along the diagonal of an ideal rectangle the corners of which are two contiguous corners of one shelf and the two corresponding corners of the overlying or underlying shelf. In practice, in a plan view of the ideal plane on which the tubular portion 4, 4*a*, 4*b*, 4*c* lies, the two shelves 2, 2*a*, 2*b*, 2*c* and the tubular portion 4, 4*a*, 4*b*, 4*c* that mutually connects the coils of these two shelves assume, as a whole, the shape of a letter Z.

Figure 2:
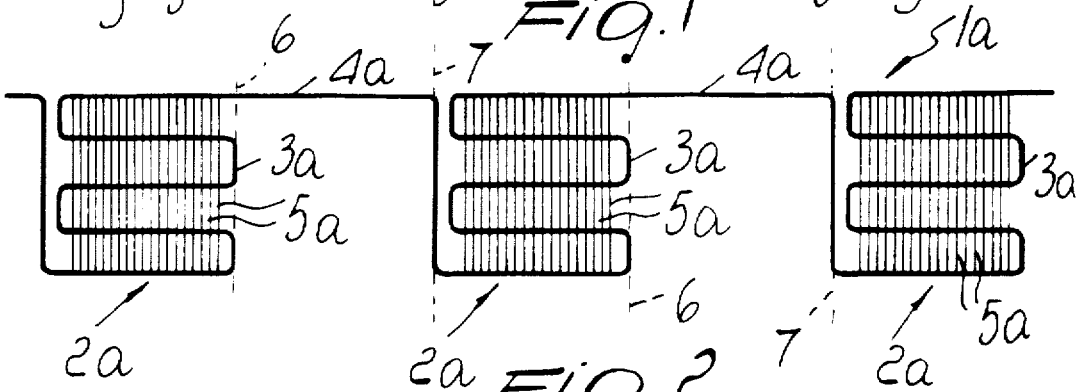
FIG. 2 is a view of a different embodiment of the heat exchanger according to the invention, again laid out on a plane.
Figure 3:
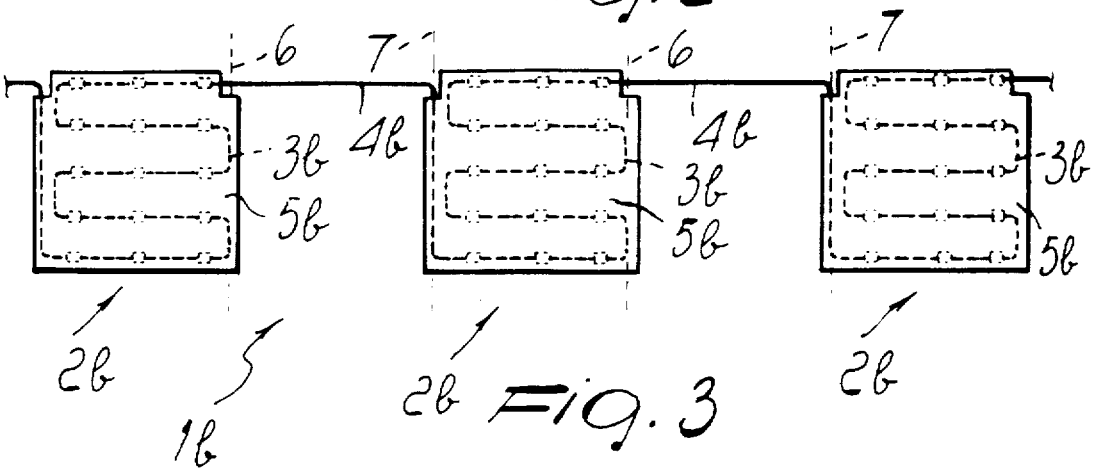
FIG. 3 is a view of a heat exchanger of the type shown in FIG. 2, with the supporting and/or heat-exchange enhancing structure constituted by a plate instead of by rods.
Figure 4:
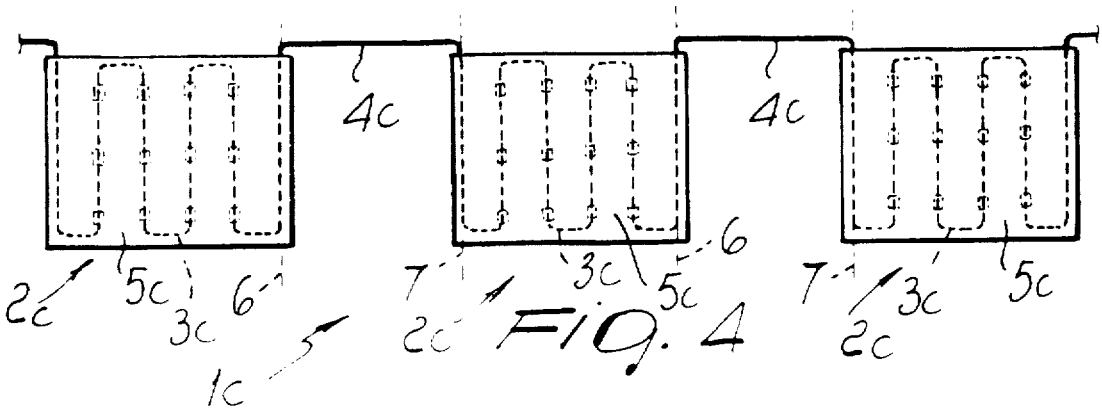
FIG. 4 is a view of another embodiment of the heat exchanger according to the invention, laid out on a plane.
Figure 5:
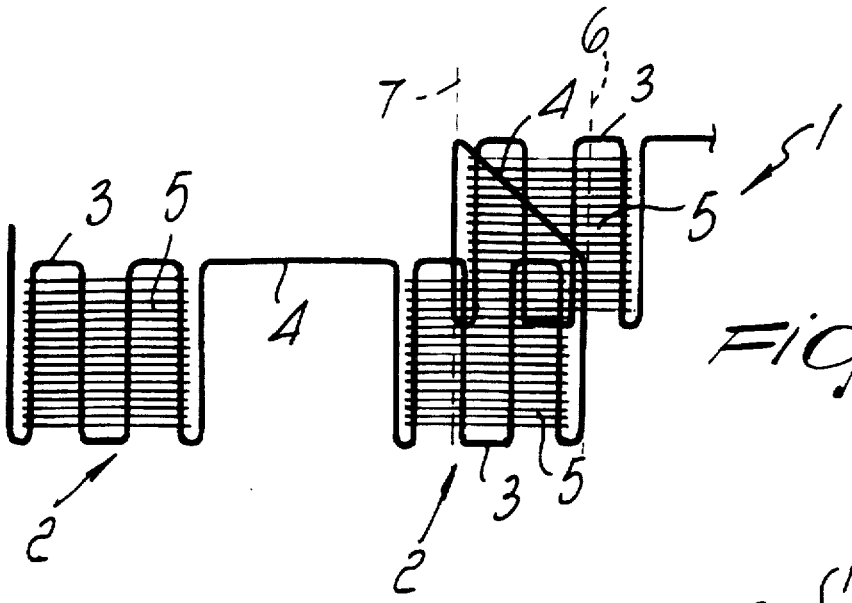
FIGS. 5 and 6 are perspective views of two intermediate steps of the construction of the heat exchanger illustrated in FIG. 1.
Figure 6:
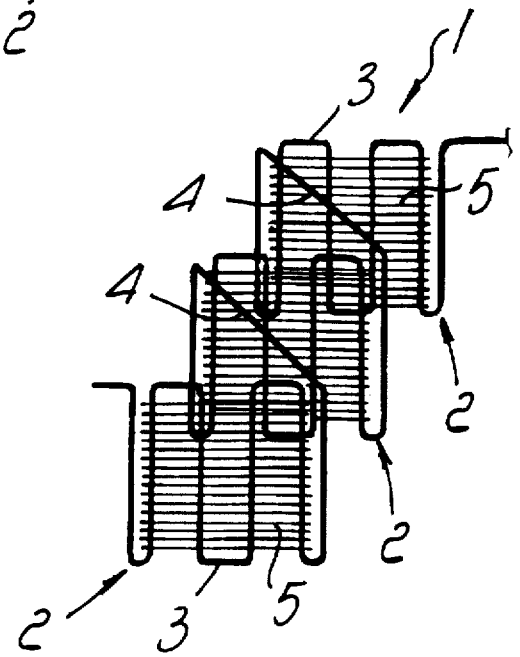
Figure 9:
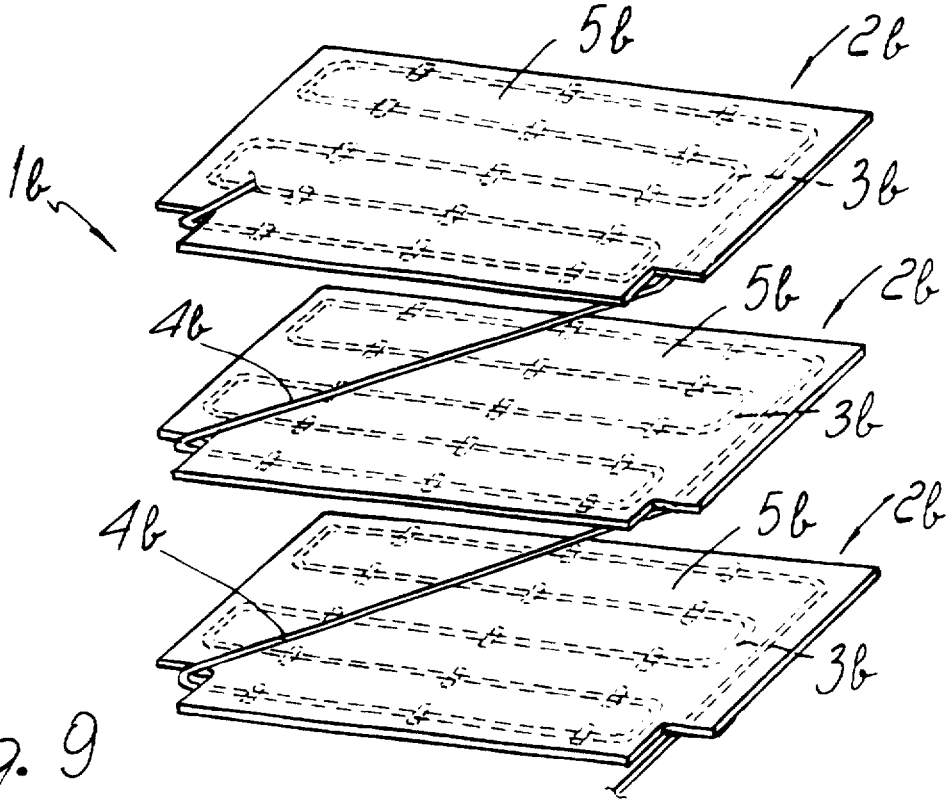
FIG. 9 is an enlarged-scale perspective view of the heat exchanger illustrated in FIG. 3, at the end of its construction.

The coil 3, 3*a*, 3*b*, 3*c* of each shelf is connected to a supporting and/or heat-exchange enhancing structure 5, 5*a*, 5*b*, 5*c* which, as shown in FIGS. 1, 2, 5, 6 and 8, can be constituted by a plurality of mutually parallel rods which are perpendicular to the longer straight portions of the coil and are connected, for example by welding, to one on both faces of the associated coil 3, 3*a*, 3*b*, 3*c*; as an alternative, said structure, as shown in particular in FIGS. 3, 4 and 9, can be constituted by a plate-like element connected, for example by seaming, welding or glueing, to one of the two faces of the coil 3, 3*a*, 3*b*, 3*c*.

As shown in the various figures, the branches of the coils joined to the portion 4, 4*a*, 4*b*, 4*c* that mutually connects two coils of two contiguous shelves are disconnected from the supporting and/or heat-exchange enhancing structure constituted by rods or plates so as to allow bending of this side without problems, as will become apparent hereinafter.

In order to form the rack heat exchanger according to the invention, the various coils 3, 3*a*, 3*b*, 3*c*, as well as the tubular portions 4, 4*a*, 4*b*, 4*c* mutually connecting them, are formed by bending, in a single plane, a single tubular body or a plurality of mutually welded tubular bodies, as shown in particular in FIGS. 1 to 4.

The supporting structures 5, 5*a*, 5*b*, 5*c* are then connected to the various coils that constitute the heat exchanger according to the invention; these structures have the purpose of forming a plane suitable to support the products inside the refrigerator or freezer and at the same time of increasing the heat-exchange surface of the coils. It should be noted that connection of the supporting structures, whether constituted by a plurality of mutually parallel rods or by plate-like elements, is particularly easy even if the various coils are constituted by a single tubular body, since it can be performed on a single working surface by arranging the various coils one after the other along the same line. Furthermore, if the supporting structure is constituted by a plate, the various plates can be connected to a same face of the various coils arranged sequentially on the working surface.

In the flattened arrangement, as shown in FIGS. 1 to 4, the tubular portions 4, 4*a*, 4*b*, 4*c* that mutually connect the various coils 3, 3*a*, 3*b*, 3*c* are arranged parallel to the direction along which the various coils are arranged side by side, and more particularly they are arranged along a straight line containing one of the sides of the various shelves. The length of the tubular portion 4, 4*a*, 4*b*, 4*c* that mutually connects two contiguous shelves suitable to be stacked one above the other is equal to the length of the diagonal of a rectangle in which the base is the side of the shelf parallel to the tubular portion 4, 4*a*, 4*b*, 4*c* and the height is the desired height between two stacked contiguous shelves. According to the requirements, the tubular portion 4, 4*a*, 4*b*, 4*c*, in the flattened arrangement of the heat exchanger, can be parallel to the longer straight portions of each individual coil, as shown in FIGS. 2 and 3, or can be perpendicular to the longer straight portions of each coil, as shown in FIG. 1.

The various shelves are stacked by locking two contiguous coils 3, 3*a*, 3*b*, 3*c*, for example by means of clamp devices, and by moving one coil above the other by shifting it parallel to its own position. This movement stacks the shelves and produces the bending and diagonal arrangement of the tubular portions 4, 4*a*, 4*b*, 4*c* that connect the various coils.

As an alternative, the various shelves can also be stacked by rotating one shelf, together with the portion 4, 4*a*, 4*b*, 4*c* that connects it to the contiguous shelf above which it must be stacked, with respect to the contiguous shelf about an axis 6 substantially coinciding with the side of the contiguous shelf directed toward the shelf which is rotated and is at right angles with respect to the portion 4, 4*a*, 4*b*, 4*c* that mutually connects the two shelves, and by simultaneously or subsequently rotating the shelf being considered by the same extent but in the opposite direction with respect to the portion 4, 4*a*, 4*b*, 4*c* that connects it to the contiguous shelf, about an axis 7 parallel to the axis 6 and substantially coinciding with the side of the shelf being considered directed toward the contiguous shelf.

Figure 7:
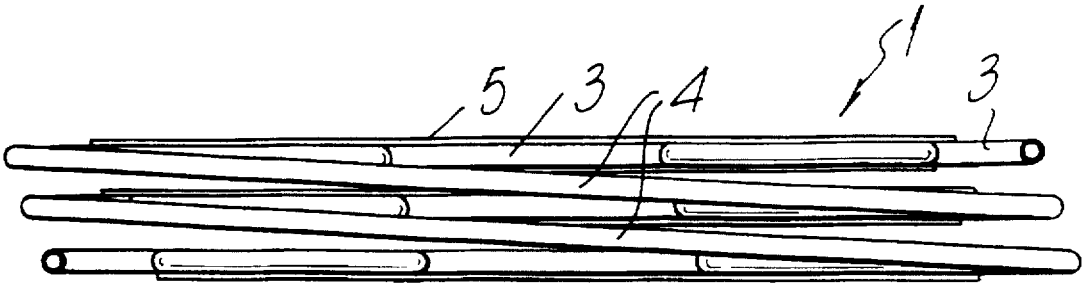
FIG. 7 is a lateral elevation view of the heat exchanger according to the invention, in a particular arrangement obtainable during packaging or shipping.
Figure 8:
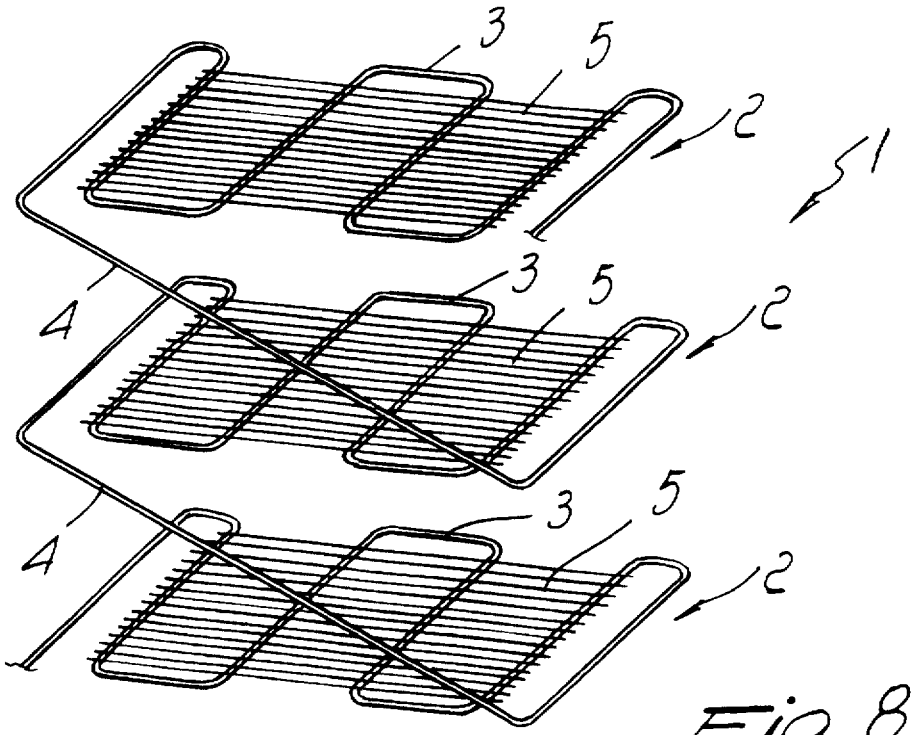
FIG. 8 is an enlarged-scale perspective view of the heat exchanger illustrated in FIG. 1, at the end of its construction.

During packaging, surface treatment or shipping of the rack heat exchanger according to the present invention, the various shelves laying on superimposed planes constituting the heat exchanger can be compacted, i.e. moved mutually closer, as shown in FIG. 7, by utilizing the elasticity and torsional deformability of the material of which the tubular body composing them is made. It should be noted that the torsional deformability of the coil branches connected to the tubular portion that mutually connects in fluid communication the serpentine coils of two shelves is facilitated by the fact that said branches are disconnected from the supporting and/or heat-exchange enhancing structure and therefore such branches are adapted to freely and elastically twist about. In this manner, the rack heat exchanger according to the invention has an extremely limited bulk and facilitates packaging and shipping operations, as well as the execution of possible treatments, such as for example galvanization treatments or other treatments to which it must be subjected.

In practice it has been observed that the rack heat exchanger according to the present invention fully achieves the intended aim, since the particular construction of the connection of the coils in the various shelves reduces its bulk during packaging and shipping, as well as during possible treatments, and makes it particularly easy, and feasible with modest production costs, to manufacture it.

Although the heat exchanger has been conceived particularly to be used as a rack evaporator, it can nonetheless be used as heat exchanger in general with the coils arranged in horizontal, vertical or inclined planes according to the requirements.

The heat exchanger thus conceived is susceptible to numerous modifications and variations, all of which are within the scope of the inventive concept; all the details may furthermore be replaced with other technically equivalent elements.

In practice, the materials employed, so long as they are compatible with the specific use, as well as the dimensions, may be any according to the requirements and the state of the art.

I claim:

1. A rack heat exchanger for use as a rack evaporator in refrigerators, freezers and the like comprising:

a plurality of stacked shelves defining superimposed planes;

a plurality of serpentine coils, with a serpentine coil for each of said shelves, each of said serpentine coils being constituted by at least one tubular body, said tubular body extending along a serpentine path in which bends alternate with straight branch portions, said serpentine path extending in a same one of said planes;

a plurality of supporting and heat-exchange enhancing structures, with a supporting structure for each of said shelves, each of said structures being connected to a respective one of said serpentine coils for allowing that at least an end branch portion of said serpentine coils freely and elastically twists about a longitudinal axis of said tubular body constituting said branch portion;

a plurality of tubular portions being in fluid communication with said serpentine coils, each of said tubular portions connecting the serpentine coil end branch portion of a shelf with an end branch of a contiguous underlying serpentine coil, the tubular portion extending in a generally diagonal direction from a first corner of a shelf to a second corner of a further underlying shelf, said second corner being opposite to a corner of said further shelf which is immediately underlying said first corner.

2. Heat exchanger according to claim 1, wherein, in each shelf, the coil lies within an ideal rectangle.

3. Heat exchanger according to claim 1, wherein said tubular portion that mutually connects the coils of two shelves extends along the diagonal of an ideal rectangle the corners of which are two contiguous corners of one shelf and the two corresponding corners of the overlying or underlying shelf, said plurality of tubular portions being arranged in a same vertical ideal plane.

4. Heat exchanger according to claim 1, wherein the coils of the various shelves and the tubular connecting portions are constituted by a single tubular body.

5. Heat exchanger according to claim 1, wherein said supporting and heat-exchange enhancing structure is constituted by a plate connected to a face of each coil.

6. Heat exchanger according to claim 5, wherein the supporting and heat-exchange enhancing structure is connected to at least one face of said coils, said supporting structure being fixed to the branch portions of said coils except for the end branch portions of the coils joined to the tubular portion that connects two mutually contiguous coils.

7. Heat exchanger according to claim 1, wherein said supporting and heat-exchange enhancing structure is constituted by a plurality of metal rods connected to at least one face of the associated coil, said rods being arranged parallel to one another and transversely to the longer straight portions of the associated coil.

8. Heat exchanger according to claim 7, wherein the supporting and heat-exchange enhancing structure is connected to at least one face of said coils, said supporting structure being fixed to the branch portions of said coils except for the end branch portions of the coils joined to the tubular portion that connects two mutually contiguous coils.

* * * * *